United States Patent [19]

Mauer

[11] Patent Number: 4,630,460

[45] Date of Patent: Dec. 23, 1986

[54] FASTENER-SETTING TOOL

[75] Inventor: Dieter Mauer, Lollar, Fed. Rep. of Germany

[73] Assignee: USM Corporation, Farmington, Conn.

[21] Appl. No.: 830,311

[22] Filed: Feb. 14, 1986

[51] Int. Cl.[4] ..... B21J 15/00

[52] U.S. Cl. ..... 72/391; 72/453.07; 72/453.17; 72/453.16

[58] Field of Search ..... 72/391, 453.16, 453.17, 72/453.18, 453.19, 114, 453.07; 29/243.53

[56] References Cited

U.S. PATENT DOCUMENTS 3,777,540 12/1973 Siebol et al. ..... 72/391
3,886,783 6/1975 Hirsch ..... 72/391
3,996,784 12/1976 Champoux et al. ..... 72/391
4,583,388 4/1986 Hogenhout ..... 72/453.16

*Primary Examiner*—Lowell Larson
*Assistant Examiner*—David B. Jones
*Attorney, Agent, or Firm*—Alan N. McCartney

[57] ABSTRACT

A pneumatic-hydraulic tool for setting two-part fasteners, for example pull-type blind riveting assemblies, has a power unit comprising a thrust member and pulling means actuated by pistons slidable, one behind the other, in a common cylinder. The pistons advance and retract as a whole under the influence of air pressure, and are separable to effect a fastener-setting stroke by admission of hydraulic fluid under high pressure between the pistons. Hydraulic fluid can be admitted and expelled to and from the cylinder between the pistons wherever along the cylinder the pistons may be.

5 Claims, 4 Drawing Figures

FASTENER-SETTING TOOL

BACKGROUND OF THE INVENTION

1. Field of the Invention

This invention is concerned with a tool for setting two-part fasteners of the kind in which one part requires to be pushed and the other pulled to set the fastener, comprising a housing, a thrust member reciprocable back and forth along an axis of the housing and having a fastener-engaging face at its forward end to push on said one part of the fastener in a fastener-setting operation, and pulling means also reciprocable within the housing along said axis to pull the other part of the fastener relative to the thrust member in the fastener-setting operation.

2. Summary of the Prior Art

Tools for setting two-part fasteners, for example blind-riveting assemblies and lockbolts, are known which comprise a housing in which there are arranged to reciprocate along a common axis a thrust member to push against a head of the rivet of a blind-riveting assembly or the collar of a lockbolt and pulling means arranged to pull the mandrel of the former or the bolt of the latter, as the case may be. It is also known to effect the strokes of the thrust member and pulling means by fluid pressure. Furthermore, in U.S. Pat. No. 3,996,784, which describes in particular a lockbolt-setting tool, there is disclosed an arrangement in which the thrust member is constituted by a sleeve with a piston at its rear end, and the pulling means also comprises a sleeve, largely accommodated in that of the thrust member, and also with a piston at its rear end, the two pistons operating in the same fluid pressure cylinder, that of the pulling means behind that of the thrust member. Ports are provided in the cylinder to admit fluid under pressure at each end and at an intermediate position along the cylinder wall. Thus, operative strokes of the thrust member and pulling means can be effected by valve means controlling the flow of fluid through the said ports of the single cylinder. Some degree of independence of movement of the thrust member and pulling means is thus afforded in a simple and economic construction of tool, but such independence of movement is limited by the position of the port part way along the cylinder, the stroke of the thrust member being restricted to the part of the cylinder in front of this port and that of the pulling means to the part of the cylinder behind it.

BRIEF SUMMARY OF THE INVENTION

It is accordingly an object of this invention to provide a fluid pressure operated fastener-setting tool of the kind referred to with pistons associated with the thrust member and pulling means operable in the same cylinder and together able to travel the whole length of the cylinder with provision for fluid to be admitted between them or exhausted from between them at selected positions anywhere therealong.

The foregoing object is achieved in accordance with the invention in that a tool for setting two-part fasteners of the kind in which one part requires to be pushed and the other pulled to set the fastener, comprising a housing, a thrust member reciprocable back and forth along an axis of the housing and having a fastener-engaging face at its forward end to push on said one part of the fastener in a fastener-setting operation, and pulling means also reciprocable within the housing along said axis to pull the other part of the fastener relative to the thrust member in the fastener-setting operation. The thrust member comprises a sleeve with a piston at its rear end slidable in a fluid-pressure cylinder, and said pulling means also comprises a sleeve projecting forwardly into that of the thrust member and having a piston at its rear end slidable in said cylinder behind that of the thrust member. Fluid passages are provided in the housing to enable pressurized fluid to act on the rear of the piston of the pulling means to advance both pistons, and in front of the piston of the thrust member to retract them both. There is also a fluid passage through the sleeve of the pulling means adjacent its piston which thus opens into said cylinder between said pistons and through which fluid under pressure can be introduced to separate said pistons and effect a fastener-setting stroke of the tool.

Preferably, in a tool in accordance with the invention, means is provided to supply air under pressure to said cylinder in front of the piston of the thrust member and behind the piston of the pulling means, and means to supply hydraulic fluid to the inside of the cylinder of the pulling means for admission to the cylinder between said pistons. Preferably, also, a hollow cylindrical rod or sleeve of the housing extends forwardly from an end cap at the rear end of said cylinder, through an annular seal in the piston of the pulling means, and terminates in an annular seal bearing on the inner surface of the sleeve of the pulling means, hydraulic fluid for admission to said cylinder between said pistons passing through the hollow rod from the rear, through a passage in the wall of the hollow rod just behind its annular seal, and through the annular chamber between said rod and the last mentioned sleeve to said passage through the wall adjacent the piston of the pulling means. The hollow rod just referred to may have a double cylindrical wall, the hydraulic fluid flowing through a space, sealed at each end, between the walls.

A tool in accordance with the invention may be adapted for setting pull-type blind-riveting assemblies, in which case the thrust member provides a nosepiece to abut the head of a rivet of a blind-riveting assembly and the pulling means is arranged to pull the mandrel stem, the tool also comprising valve control means effective to admit air behind the rear piston to advance both pistons to the front end of the cylinder, to admit hydraulic fluid between the pistons to set the rivet, and to admit air in front of the forward piston to retract both pistons and expel hydraulic fluid from therebetween.

A blind-riveting tool with power operated means in accordance with the invention is especially suitable where retraction of the thrust member within the housing is desirable to facilitate feeding of a fresh blind-riveting assembly to the nosepiece after each rivet-setting operation. Such a tool in accordance with this invention is the subject of our contemporaneous U.S. patent application No. 830,150, and will not be fully described in detail so far as the construction of the tool, other than the power unit, is concerned.

There now follows a detailed description, to be read with reference to the accompanying drawings, of a power unit of a blind-riveting tool in accordance with the invention and illustrative thereof. It will be realized that this illustrative tool has been selected for description by way of example and not of limitation of the invention.

DESCRIPTION OF THE PREFERRED EMBODIMENT

Figure 1:
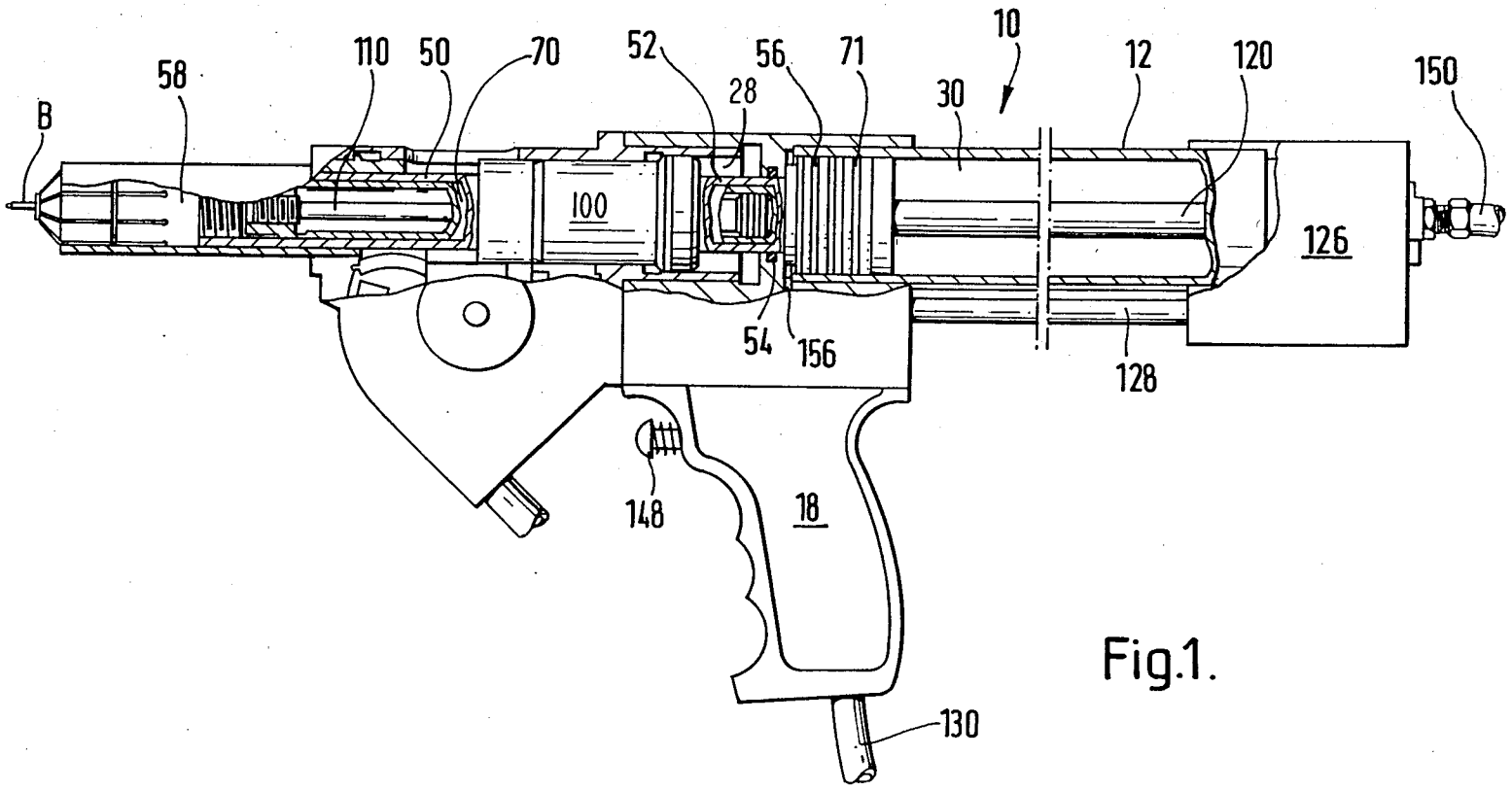
FIG. 1 is a view in side elevation and partly in longitudinal section of the illustrative tool, the tool having been loaded with a blind-riveting assembly and being ready for presentation to a workpiece for a blind-riveting operation.

Referring to FIG. 1, the illustrative tool comprises a housing 10 with a rearward extension which provides a pneumatic/hydraulic cylinder 12, through which a bore 30 extends.

Figure 2:
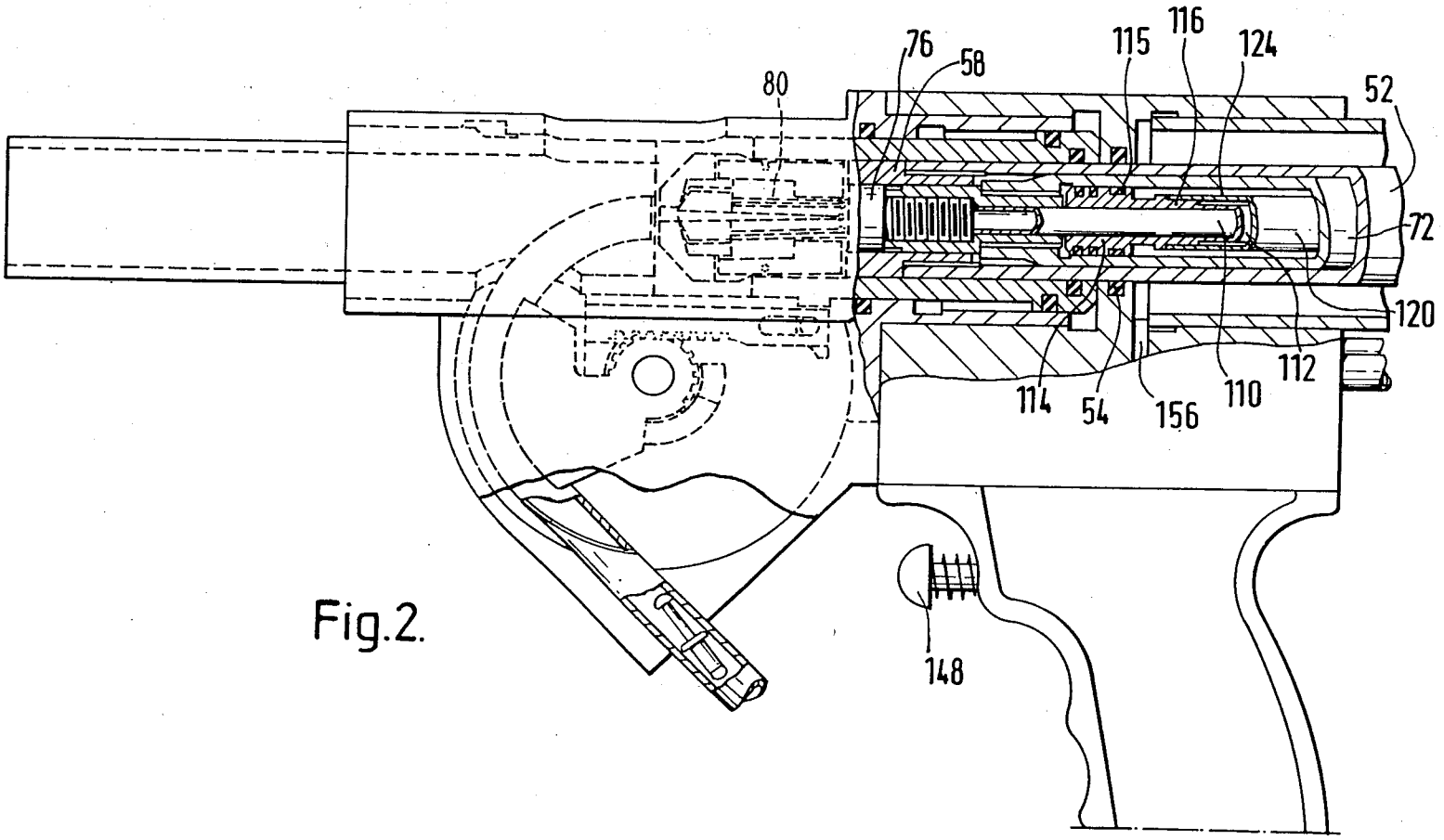
FIGS. 2 and 3 are fragmentary views showing, on a larger scale than FIG. 1, details of construction of two pistons and associated parts of the power unit depicted in FIG. 1.

Mounted for axial reciprocation in the housing 10 is an abutment, or thrust, member 50 (FIG. 1) comprising a hollow cylindrical sleeve 52 slidable through an annular seal 54 (FIG. 2) in the housing and having at its rear end a hollow piston 56 slidable in the bore 30. Screw threaded into the front end of the sleeve 52 is a nosepiece 58.

Within the abutment member 50 is a second hollow piston assembly which constitutes mandrel-pulling means 70 of the illustrative tool. The mandrel-pulling means 70 comprises, at its rear end, a hollow piston 71 (FIGS. 1 and 3) slidable in the bore 30 of the cylinder 12 behind the piston 56. The piston 71 is secured to a sleeve 72 of the mandrel-pulling means slidable through an annular seal 57 in the piston 56. At its forward end, the sleeve 72 carries a collet 80.

The construction of the illustrative tool, and its operation for setting blind-riveting assemblies, are fully described in our copending U.S. patent application No. 830,150 filed contemporaneously with this application.

Figure 3:
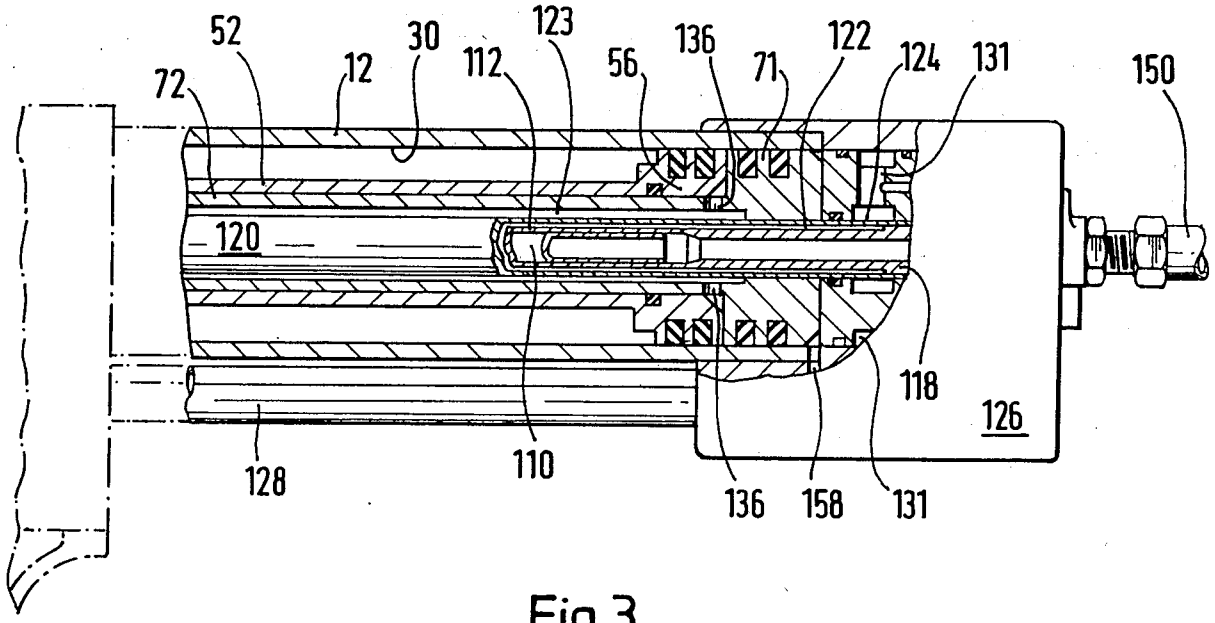

Rearwardly projecting from the collet 80 to provide a small diameter passage through the pulling means 70 is a tube 110 (FIGS. 2 and 3) which passes freely into a hollow sleeve 112. The sleeve 112 has an enlarged head 114 at its front end, which has an annular seal 115 bearing on the inside wall of the sleeve 72. Most of the length of the sleeve 112, between two bearing portions 116 (just behind the head 114 in FIG. 2) and 118 (FIG. 3), is of reduced diameter, and the bearing portions carry a sleeve 120 so that between these portions within the sleeve 120 there is an annular chamber 122 (FIG. 3). The sleeve 120 has an outer diameter which is less than the inner diameter of the sleeve 72 so as to provide an annular chamber 123 therebetween. Communication between the chambers 122 and 123 is provided for by ports 124 at each end of the sleeve 120 adjacent the bearing portions 116,118; as will become apparent, the full stroke of the piston 71 takes place between these ports. The sleeve 112 at its rearward end is firmly secured to an end cap 126 mounted on the cylinder 12; the sleeve 112 and head 114 are thus fixed in the housing 10.

The housing 10 of the illustrative tool is provided with passages for oil and air for effecting forward and return strokes of the pistons 56 and 71. Thus, in a handle 18 of the housing 10 is an inlet 130 through which oil can flow via a tube 128 to and from the end cap 126. Means for connecting the inlet 130 to an oil pressure intensifier is not shown in the drawings, being of conventional construction. From the tube 128 oil is able to flow through passageways 131 in the end cap 126, through the port 124 at the rear end of the sleeve 120 into the annular chamber 122 between the sleeves 112 and 120, and hence through the port 124 at the front into the annular chamber 123 inside the sleeve 72 of the mandrel-pulling means 70. Ports 136 open through the sleeve 72 just in front of the piston 71 (FIG. 3); pressurized oil which thus flows through the ports 136 into the bore 30 of the cylinder 12 is effective to exert pressure on the pistons 56 and 71 urging them to separate. Release of oil pressure allows it to flow back through the system just described.

While the rear of the piston 56 and the front of the piston 71 are always exposed to oil at the pressure supplied at the inlet 130, the front of the piston 56 and the rear of the piston 71 are always exposed to air. Thus, air is introduced and expelled to and from the front and rear of the cylinder 12 through suitable ports 156 (FIG. 2) and 158 (FIG. 3) and passageways in the housing 10 not fully described herein, but following normal practice with double-acting cylinders.

Suitable means are provided for controlling the flow of fluid in the illustrative tool to effect movement of the pistons and to control the sequence that is fully described in the said copending patent application, but will here be briefly summarized so far as the power unit is concerned.

A cycle of operation of the rivet-setting parts of the illustrative tool can best be regarded as starting with the abutment member 50 and mandrel-pulling means 70 in their forward positions as depicted in FIG. 1.

Figure 4:
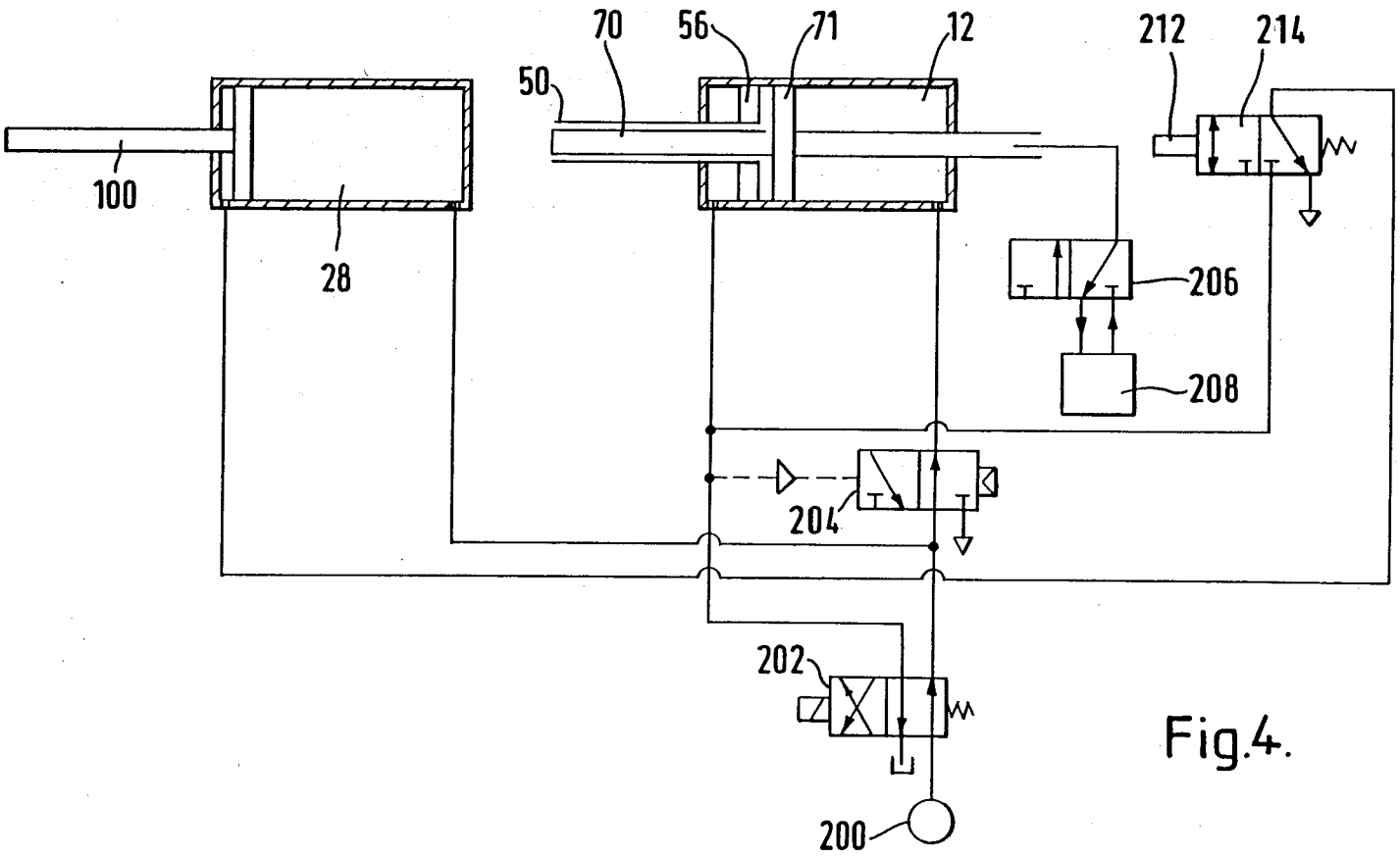
FIG. 4 is circuit diagram of fluid control means of the tool.

Means for controlling the flow of air and hydraulic fluid to operate parts of the tool in sequence is depicted diagrammatically in FIG. 4. When the tool is at rest as shown in FIG. 1, air from a compressed air supply 200 passes through a two-position valve 202 to the rear end of the cylinder 12 behind the piston 71. The abutment member 50 is thus held in the housing in its foremost position by air under pressure in the cylinder 12 behind the piston 71, which bears on the piston 56, oil pressure at the inlet 130 being atmospheric.

The tool may now be presented to a workpiece (not shown), the rivet of a blind-riveting assembly B being inserted into a hole in the workpiece by the nosepiece 58. On the hand grip 18 is a push-button switch of an electrical control circuit which, on now being depressed by the operator, actuates a solenoid valve 206 in an hydraulic circuit with the result that oil under pressure from a pressure intensifier 208 is admitted to the inlet 130 and thence to the cylinder 12 between the pistons 56 and 71. At the same time, a valve 202 is actuated to open immediately a path to exhaust air from behind the piston 71. The oil forces the pistons 56 and 71 apart, thus pulling the mandrel while pushing on the rivet head in a conventional manner thereby to set the rivet; the mandrel eventually breaks at a neck within the rivet where the mandrel stem is of reduced cross-section and the broken-off portion of the mandrel stem may be ejected rearwardly along the tube 110 and sleeve 112 to a hose 150 leading to a suitable receptacle. Separation of the pistons 57 and 71 is limited by the mechanical construction of parts at the forward end of the tube described in said copending application.

Actuation of the valve 202 also opened the bore 28 behind the sleeve 100 to exhaust, and pressurized an air line 210 leading to the front of the cylinder 12. The piston 56 could not at that time retract, however, because the pulling means 70 was held forward by the mandrel. But when the mandrel breaks, the piston 56 moves rearwardly, pushing back the piston 71. After a time delay pre-set in the electrical control circuit, the solenoid valve 206 is de-energized, reversing under spring pressure to allow oil to flow out of the cylinder 12 from between the pistons 56,71.

Later in the operating cycle of the illustrative tool, after a fresh blind-rivet assembly has been loaded into the nosepiece 58, the abutment member 50 and mandrel-pulling means 70 are advanced by admission of air to the bore 30 behind the piston 71 to restore the tool to the condition shown in FIG. 1. Advance of the pistons 56 and 71 to their forward positions are effected by reversal of the valve 202 by de-energization of its solenoid, which occurs at predetermined time after pressing the button 148 as set by a time delay in the electrical control circuit. The tool is thus restored to the condition shown in FIG. 1 whether or not the operator has released the button 148, but a second cycle will not be commenced until he has both released and again pressed the button.

In the illustrative tool oil under high pressure is introduced between the pistons 56,71 when they are together at the front of the cylinder 12, and oil is expelled from between them when the piston 56 begins to move back along the cylinder, or so soon thereafter as the valve 206 is de-energized. In any event, the construction permits the introduction and expulsion of fluid to and from the cylinder 12 wherever along it the pistons may be, and whether both, as a whole, are stationary or moving.

I claim:

1. A tool for setting two-part fasteners of the kind in which one part requires to be pushed and the other pulled to set the fastener, comprising a housing, a thrust member reciprocable back and forth along an axis of the housing and having a fastener-engaging face at its forward end to push on said one part of the fastener in a fastener-setting operation, and pulling means also reciprocable within the housing along said axis to pull the other part of the fastener relative to the thrust member in the fastener-setting operation, characterized in that the thrust member comprises a sleeve with a piston at its rear end slidable in a fluid-pressure cylinder, and said pulling means also comprises a sleeve projecting forwardly into that of the thrust member and having a piston at its rear end slidable in said cylinder behind that of the thrust member, fluid passages being provided in the housing to enable pressurized fluid to act on the rear of the piston of the pulling means to advance both pistons, and in front of the piston of the thrust member to retract them both, there being also a fluid passage through the sleeve of the pulling means adjacent its piston which thus opens into said cylinder between said pistons and through which fluid under pressure can be introduced to separate said pistons and effect a fastener-setting stroke of the tool.

2. A tool according to the claim 1 further characterized in that means is provided to supply air under pressure to said cylinder in front of the piston of the thrust member and behind the piston of the pulling means, and means to supply hydraulic fluid to the inside of the sleeve of the pulling means for admission to the cylinder between said pistons.

3. A tool according to claim 2 further characterized in that a hollow cylindrical rod of the housing extends forwardly from an end cap at the rear end of said cylinder, through an annular seal in the piston of the pulling means, and terminates in an annular seal bearing on the inner surface of the sleeve of the pulling means, hydraulic fluid for admission to said cylinder between said pistons passing through the hollow rod from the rear, through a passage in the wall of the hollow rod just behind its annular seal, and through the annular chamber between said rod and the last-mentioned sleeve to said passage through the wall adjacent the piston of the pulling means.

4. A tool according to claim 3 further characterized in that the hollow rod has a double cylindrical wall, the hydraulic fluid flowing through a space, sealed at each end, between the walls.

5. A tool according to claim 2 adapted for use in blind riveting, and further characterized in that the thrust member provides a nosepiece to abut the head of a rivet of a blind-riveting assembly and the pulling means is arranged to pull the mandrel stem, the tool also comprising valve control means effective to admit air behind the rear piston to advance both pistons to the front end of the cylinder, to admit hydraulic fluid between the pistons to set the rivet, and to admit air in front of the forward piston to retract both pistons (56,71) and expel hydraulic fluid from therebetween.

* * * * *